US011324317B2

(12) United States Patent
Mahlberg

(10) Patent No.: US 11,324,317 B2
(45) Date of Patent: May 10, 2022

(54) SHELF SUPPORT AND ARRANGEMENT

(71) Applicant: Simple Furniture Group Oy, Helsinki (FI)

(72) Inventor: Stefan Mahlberg, Helsinki (FI)

(73) Assignee: SIMPLE FURNITURE GROUP OY, Helsinki (FI)

( * ) Notice: Subject to any disclaimer, the term of this patent is extended or adjusted under 35 U.S.C. 154(b) by 0 days.

(21) Appl. No.: 16/648,376

(22) PCT Filed: Sep. 12, 2018

(86) PCT No.: PCT/FI2018/050651
§ 371 (c)(1),
(2) Date: Mar. 18, 2020

(87) PCT Pub. No.: WO2019/058025
PCT Pub. Date: Mar. 28, 2019

(65) Prior Publication Data

US 2020/0221872 A1 Jul. 16, 2020

(30) Foreign Application Priority Data

Sep. 21, 2017 (FI) ..... 20175839

(51) Int. Cl.
*A47B 96/00* (2006.01)
*A47B 96/06* (2006.01)
*A47B 57/34* (2006.01)

(52) U.S. Cl.
CPC ..... *A47B 96/068* (2013.01); *A47B 57/34* (2013.01)

(58) Field of Classification Search
None
See application file for complete search history.

(56) References Cited

U.S. PATENT DOCUMENTS 2,826,388 A * 3/1958 Alfredg ..... F25D 23/067 248/239
4,639,161 A * 1/1987 Mazaki ..... F16B 12/2063 403/245

(Continued)

FOREIGN PATENT DOCUMENTS

FR 2599952 A1 12/1987
GB 1170906 A 11/1969

(Continued)

OTHER PUBLICATIONS

Finnish Patent and Regitration Office, Search Report dated Apr. 16, 2018 issued in Finnish Patent Application No. 20175839.

(Continued)

*Primary Examiner* — Steven M Marsh
(74) *Attorney, Agent, or Firm* — Robert P. Michal, Esq.; Carter, DeLuca & Farrell LLP

(57) ABSTRACT

The invention relates to a shelf support for supporting a shelf plate and to an arrangement in a shelf. The shelf support comprises a support part arranged to be extending outside of the side wall aperture, a pin part arranged to be inserted into the side wall aperture and a stopping surface provided to the support part. The pin part protrudes from the stopping surface and the stopping surface is arranged to be placed against the side wall surface when the pin part is inserted into the side wall aperture. The pin part further extends from the stopping surface in a pin angle (X, Y) in relation to a direction (A) perpendicular to the stopping surface.

11 Claims, 13 Drawing Sheets

(56) References Cited

U.S. PATENT DOCUMENTS

| | | | | | |
|---|---|---|---|---|---|
| 5,359,944 | A * | 11/1994 | Steinbeck | A47B 13/08 | 403/294 |
| 5,468,109 | A * | 11/1995 | Ferrari | F16B 12/24 | 411/553 |
| 10,716,401 | B2 * | 7/2020 | Dalstam | F16B 12/46 | |
| 10,881,200 | B2 * | 1/2021 | Feldman | A47B 47/047 | |
| 2013/0287484 | A1 * | 10/2013 | Phillips | A47B 47/0025 | 403/298 |

FOREIGN PATENT DOCUMENTS

| | | | |
|---|---|---|---|
| GB | 2118026 | A | 10/1983 |
| JP | S49105421 | U | 9/1974 |
| WO | 2017105324 | A1 | 6/2017 |

OTHER PUBLICATIONS

ISA/FI, PCT International Search Report and Written Opinion dated Dec. 19, 2018 issued in PCT International Application No. PCT/FI2018/050651.

* cited by examiner 70
60
O
B
76

60
70
Q
B
D
O
76

74
70
O
62
M
72
73
76
60
61
71

SHELF SUPPORT AND ARRANGEMENT

CROSS-REFERENCE TO RELATED APPLICATIONS

This application is the United States National Stage entry under 35 U.S.C. 371 of PCT/FI2018/050651, filed Sep. 12, 2018, which in turn claims the priority of Finnish Patent Application No. 20175839, filed Sep. 21, 2017, the contents of each of which are hereby incorporated by reference in their entirety.

FIELD OF THE INVENTION

The present invention relates to shelf support for supporting a shelf plate to a side wall of a shelf and more particularly to a shelf support according to the preamble of claim 1. The present invention also relates to an arrangement in a shelf and more particularly to an arrangement according to the preamble of claim 7.

BACKGROUND OF THE INVENTION

Conventionally a shelf comprises horizontal bottom plate or foundation, a horizontal top plate and at least two vertical side walls extending between the bottom plate and the top plate. The vertical side walls may be solid side wall boards, at least partly open side wall frames, side wall rails or the like. The vertical side wall comprises a bottom end, top end and a side wall surface extending between the bottom end and the top end. The vertical side wall may further comprise a front end and a back end extending also between the bottom end and the top end. One or more horizontal shelf plates is further arranged between the two vertical side walls. The shelf plates are supported to the side walls with one or more shelf supports. The side walls are provided with side wall apertures or side wall apertures extending perpendicularly to the side wall surface into the side wall. The side wall apertures are arranged to receive shelf support pegs. In a usual shelf, there are two adjacent lines of side wall apertures extending parallel between the bottom plate and top plates or upper end and lower end of the vertical side wall. Each line of side wall aperture comprises two or more successive side wall apertures along the lines of side wall apertures.

The shelf plates are supported to the vertical side walls by inserting shelf support pegs into the side wall apertures. The shelf support pegs comprise a pin part arranged to be inserted in to the side wall aperture in the vertical side wall, and a support part extending outside and outwards from the side wall aperture. The shelf plate is arranged against the support part and supported on the support part. The support parts are placed against the bottom surface of the shelf plate on a side edge area of the bottom surface of the shelf plate, or alternatively they are placed to a hole or groove provided on the side edge area of the bottom side surface of the shelf plate. Normally, one shelf plate is supported to two opposing vertical side walls with a four shelf support pegs, two on each opposite side edges of the shelf plate.

The conventional shelf support pegs are poor in staying in position in the side wall apertures which causes them to move and twist inside the side wall aperture. This further causes damages to the side wall aperture and the side wall aperture may be becoming larger, especially at the mouth of the side wall aperture. This further weakens ability of the shelf support peg to stay in the side wall aperture and in the preferred position in the side wall aperture. When the shelf support peg moves, also the shelf plate moves, which is undesirable and further increases the damages to the side wall aperture. The above mentioned disadvantage has been solved in the prior art by using screws or the like fasteners for fastening the shelf support to the shelf plate. However, this does not solve the problem associated with the shelf support peg moving and damaging the side wall aperture. One prior art way of alleviating the problem is using angle iron or the like for fastening the shelf plate to the vertical side wall. In this case screws are used both to fasten angle iron to the vertical side wall and the angle iron to the shelf plate. However, this very complex task and requires using tools as well as causes permanent damages to the vertical side wall and the shelf plate.

BRIEF DESCRIPTION OF THE INVENTION

An object of the present invention is to provide a shelf support and an arrangement such that the prior art disadvantages are solved or at least alleviated. The objects of the invention are achieved by a shelf support which is characterized by what is stated in the independent claim 1. The objects of the invention are further achieved by an arrangement which is characterized by what is stated in the independent claim 7.

The preferred embodiments of the invention are disclosed in the dependent claims.

The invention is based on the idea of providing a shelf support for supporting a shelf plate to a side wall of a shelf. The shelf support is a shelf support peg or the like part which is arranged to support a shelf plate from the side edges to the vertical side walls. The shelf support may be installed into a side wall aperture provided to a side wall surface of the vertical side wall. The shelf support comprises a support part arranged to be extending outside of the side wall aperture and to support the shelf plate. The support part is placed against the shelf plate, or the shelf plate is placed on the support parts. Usually the support parts support the shelf plate from the bottom surface or form grooves or holes provided to the bottom surface of the shelf plate. The shelf support further comprises a pin part arranged to be inserted into the side wall aperture. The shelf support may also comprise a stopping surface provided to the support part and the pin part is arranged to protrude from the stopping surface. In the shelf, the stopping surface is arranged to be placed against the side wall surface when the pin part is inserted into the side wall aperture. Thus, the stopping surface defines how far the pin part may be inserted to the side wall aperture. According to the present invention, the pin part extends from the stopping surface in a pin angle in relation to a direction perpendicular to the stopping surface. This means, that the pin part extends in an oblique angle from the stopping surface.

The support part may extend from the stopping surface in a direction perpendicular to the stopping surface, and thus the pin part and the support part extend in an angle relation to each other, preferably this angle corresponds the pin angle.

The stopping surface may define a stopping plane. In this embodiment, the pin part may extend from the stopping surface in the pin angle in relation to the direction perpendicular to the stopping plane. When the pin part extends from the stopping surface in the pin angle, the pin part must be inserted into the side wall aperture according to the angle, as the side wall aperture extends preferably into the side wall an aperture angle in relation to the side wall surface. Thus, the side surfaces of the side wall aperture prevent the pin part from coming out of the side wall aperture if the shelf support is pulled out of the side wall aperture in a direction perpendicular to the side wall surface. The stopping surface further prevents the shelf support from turning when the pin part is inserted into the side wall aperture when the stopping surface is against the side wall surface. Accordingly, the combination of stopping surface and the pin angle ensures also right orientation of the shelf support in the side wall aperture.

The support part may comprise an upper support surface arranged to be positioned towards the shelf plate or against the shelf plate in from the bottom surface of the shelf plate.

In one embodiment of the present invention the pin part may extend from the stopping surface parallel to the upper surface and in a first pin angle in relation to the direction perpendicular to the stopping plane when the shelf support is viewed from the support part towards the pin part. In one embodiment, the support part comprises the upper support surface arranged to be positioned towards the shelf plate. The upper support surface may define an upper support plane. The pin part may extend from the stopping surface in a direction parallel to the upper support plane and in the first pin angle in relation to the direction perpendicular to the stopping plane. In one embodiment, the support part comprises the upper support surface arranged to be positioned towards the shelf plate. The upper support surface may define an upper support plane. The pin part may extend from the stopping surface in a direction parallel to the upper support plane and in the first pin angle in relation to the direction perpendicular to the stopping plane. Accordingly, that means that the pin part extends from the stopping surface in horizontal direction and in the first pin angle when the upper support of the surface shelf support faces upwards, or is in horizontal direction. Thus, the pin part extends from the stopping surface horizontally and in laterally oblique angle, left or right, angle in relation to the direction perpendicular to the stopping surface or stopping plane.

In another embodiment, the pin part may extend from the stopping surface upwards or downwards in relation to the upper surface and in a second pin angle in relation to the direction perpendicular to the stopping plane when the shelf support is viewed from the support part towards the pin part. In one embodiment, the support part comprises the upper support surface arranged to be positioned towards the shelf plate. The upper support surface may define an upper support plane. The pin part may extend from the stopping surface upwards or downwards in relation to the upper support plane in the second pin angle in relation to the direction perpendicular to the stopping plane. Accordingly, that means that the pin part extends from the stopping surface upward or downwards horizontal direction and in the second pin angle when the upper support surface of the shelf support faces upwards, or is in horizontal direction. Thus, the pin part extends from the stopping surface in an oblique angle in relation into the horizontal direction, downwards or upwards, in relation to the direction perpendicular to the stopping surface or stopping plane.

In yet another embodiment, pin part may extend from the stopping surface parallel to the upper surface and in the first pin angle in relation to the direction perpendicular to the stopping plane when the shelf support is viewed from the support part towards the pin part. Furthermore, at the same time the pin part may extend from the stopping surface upwards or downwards in relation to the upper surface and in a second pin angle in relation to the direction perpendicular to the stopping plane when the shelf support is viewed from the support part towards the pin part. In one embodiment, the support part comprises the upper support surface arranged to be positioned towards the shelf plate. The upper support surface may define an upper support plane. The pin part may extend from the stopping surface upwards or downwards in relation to the upper support plane in the second pin angle in relation to the direction perpendicular to the stopping plane, and from the stopping surface in a direction parallel to the upper support plane and in the first pin angle in relation to the direction perpendicular to the stopping plane. Accordingly, that means that the pin part extends from the stopping surface in laterally oblique angle, left or right, in relation to the direction perpendicular to the stopping surface or stopping plane, also in an oblique angle in relation into the horizontal direction, downwards or upwards, in relation to the direction perpendicular to the stopping surface or stopping plane.

The stopping surface may define a stopping plane and the support part comprises the upper support surface arranged to be positioned towards the shelf plate. The upper support surface may define the upper support plane that is perpendicular to the stopping plane. In one embodiment of the present of the present invention the pin part may extend from the stopping surface in a direction parallel to the upper support plane and in the first pin angle in relation to a direction perpendicular to the stopping plane. In another embodiment, the pin part may extend from the stopping surface in the second pin angle in relation to the direction parallel to a plane which is perpendicular to the stopping plane and the upper support plane. In yet another embodiment the pin part may extend from the stopping surface in the first pin angle in relation to a direction perpendicular to the stopping plane in a direction parallel to the upper support plane and in the second pin angle in relation to the direction parallel to a plane perpendicular to the stopping plane and the upper support plane.

According to the above mentioned, the pin part may extend from the stopping surface horizontally and in an oblique angle left or right, when the shelf support is in normal use position in which upper support surface faces upwards. Alternatively, the pin part may extend from the stopping surface in an oblique angle upward or downwards in relation to horizontal direction, when the shelf support is in normal use position in which upper support surface faces upwards. Yet alternatively, the pin part may extend from the stopping surface horizontally in an oblique angle left or right and in an oblique angle upward or downwards in relation to horizontal direction, when the shelf support is in normal use position in which upper support surface faces upwards. In the latter case the pin part may extend from the stopping surface in an oblique angle upwards or downwards and left or right, when the shelf support is in normal use position in which upper support surface faces upwards.

In one embodiment of the present invention, the pin angle, or the first pin angle, or the second pin angle may be between 5 to 60 degrees, or 5 to 45 degrees, or 5 to 25 degrees, or 7 to 20 degrees. In one specific embodiment, the pin angle, or the first pin angle, or the second pin angle may be between 7 to 18 degrees, preferably between 8 to 16 degrees, or more preferably between 10 to 15 degrees.

The support part of the shelf support may comprise the upper support surface, and it may be arranged to extend from the stopping surface in a direction away from the pin part.

In embodiment one the present invention, the support part may comprise a protrusion protruding upwards from the upper support surface. The protrusion is arranged to be positioned towards the shelf plate. The protrusion may be provided to the support part at a first distance from the stopping surface.

In an alternative embodiment, the support part may comprise a protrusion protruding upwards from the upper support surface and arranged to be positioned towards the shelf plate. The protrusion may be provided to the support part at a first distance from the stopping surface. The protrusion may comprise a retaining surface extending in transverse direction in relation to the direction perpendicular to the stopping surface and upwards from the upper support surface.

In yet alternative embodiment, the support part may comprise a protrusion protruding upwards from an upper support surface and arranged to be positioned towards the shelf plate. The protrusion may be provided to the support part at a first distance from the stopping surface. The protrusion may comprise a retaining surface extending parallel to the stopping surface and upwards from the upper support surface.

The pin part extending from the stopping surface in oblique direction in relation to the direction perpendicular to the stopping surface or stopping plane may together with the mentioned protrusion effectively lock or secure the shelf plate between protrusion and the stopping surface and further to the side wall surface. Accordingly, the shelf plate may be secured to the side wall surface without additional fastening means, such as screws and without using any tools.

The present invention further relates to an arrangement in a shelf. The arrangement comprises two opposing vertical side walls. The two opposing vertical side walls comprises a bottom end, a top end, a first side edge, a second side edge and a side wall surface provided between the bottom and top ends and the first and second side edges. The vertical side walls may comprise one or more side wall apertures provided to the side wall surfaces of the two opposing vertical side walls. The side wall apertures extending from the side wall surfaces into the vertical side walls. The arrangement further comprises one or more shelf supports for supporting a shelf plate to the vertical side walls. The one or more shelf supports comprise a pin part arranged inside the side wall aperture and a support part protruding outside of the side wall aperture from the side wall surface. The arrangement also comprises the horizontal shelf plate provided between the two opposing vertical side walls and supported on the support parts of the one or more shelf support.

According to the present invention, the one or more side wall apertures extend from the side wall surfaces into the vertical side walls in an aperture angle in relation to a direction perpendicular to the side wall surface. Furthermore, the pin part of the shelf support is arranged to extend into the side wall aperture from the support part in a pin angle in relation to the support part.

In one embodiment, the support part protrudes from the side wall surface in the direction perpendicular to the side wall surface. Therefore, the aperture angle may correspond the pin angle. In an alternative embodiment, the support part protrudes from the side wall surface in a support angle in relation to the direction perpendicular to the side wall surface. Therefore, in this embodiment the aperture angle differs the pin angle.

The two side walls comprise a vertical cross-sectional plane extending perpendicularly to the side wall surface between the bottom end and the top end and parallel to longitudinal direction of the one or more side walls between the bottom end and top end. Thus, vertical cross-sectional plane means a plane which is formed by cutting the side wall in two halves in the longitudinal direction between the bottom end and the top end. The two side walls also comprise a horizontal cross-sectional plane extending perpendicularly to the side wall surface between the first edge and the second edge and perpendicularly to longitudinal direction of the one or more side walls between the bottom end and top end. Thus, horizontal cross-sectional plane means a plane which is formed by cutting the side wall in two halves in a direction perpendicular to the longitudinal direction between the first edge and second edge.

In one embodiment of the present invention the one or more side wall apertures extend parallel to the horizontal cross-sectional plane and in a first aperture angle in relation to the vertical cross-sectional plane. Accordingly, the one or more side wall apertures extend in the horizontal cross-sectional plane and towards the first or second side edge of the vertical side wall.

In an alternative embodiment, the one or more side wall apertures extend parallel to the vertical cross-sectional plane and in a second aperture angle in relation to the horizontal cross-sectional plane. Accordingly, the one or more side wall apertures extend in the vertical cross-sectional plane and towards the bottom end or top end of the vertical side wall.

In a yet alternative embodiment, the one or more side wall apertures extend in a first aperture angle in relation to the vertical cross-sectional plane and in a second aperture angle in relation to the horizontal cross-sectional plane. Accordingly, the one or more side wall apertures extend in an oblique angle towards the bottom end or top end and towards first edge or second edge of the vertical side wall.

In one embodiment of the present invention, the aperture angle, or the first aperture angle, or the second aperture angle may be between 5 to 60 degrees, or 5 to 45 degrees, or 5 to 25 degrees, or 7 to 20 degrees. In one specific embodiment, the aperture angle, or the first aperture angle, or the second aperture angle may be between 7 to 18 degrees, preferably between 8 to 16 degrees, or more preferably between 10 to 15 degrees.

The one or more side wall surfaces may comprise at least one pair of adjacent side wall apertures. Usually the side wall surface may comprise several pairs of side wall apertures arranged successively between the bottom end and the top end of the vertical side wall. The pair of adjacent side wall apertures may comprise a first side wall aperture and a second side wall aperture. It should be noted that there may also be three or more adjacent side wall apertures.

In one embodiment, the first side wall aperture may extend parallel to the horizontal cross-sectional plane and in the first aperture angle towards the second side edge of the vertical side wall, and the second side wall aperture may extend parallel to the horizontal cross-sectional plane and in the first aperture angle towards the first side edge of the vertical side wall. Accordingly, in this embodiment the first and second ide wall apertures extend in different directions toward each other.

In an alternative embodiment, the first side wall aperture may extend parallel to the horizontal cross-sectional plane and in the first aperture angle towards the first side edge of the vertical side wall, and the second side wall aperture may extend parallel to the horizontal cross-sectional plane and in the first aperture angle towards the second side edge of the vertical side wall. Accordingly, in this embodiment the first and second side wall apertures extend in different directions away from each other.

In still another embodiment, the first side wall aperture may extend parallel to the vertical cross-sectional plane and in the second aperture angle towards the top end of the vertical side wall, and the second side wall aperture may extend parallel to the vertical cross-sectional plane and in the second aperture angle towards the bottom end of the vertical side wall. Accordingly, in this embodiment the first and second side wall apertures extend in different directions in relation to horizontal direction.

In yet another embodiment, the first side wall aperture may extend parallel to the vertical cross-sectional plane and in the second aperture angle towards the bottom end of the vertical side wall, and the second side wall aperture may extend parallel to the vertical cross-sectional plane and in the second aperture angle towards the top end of the vertical side wall. Accordingly, also in this embodiment the first and second side wall apertures extend in different directions in relation to horizontal direction.

In a further embodiment of the invention, the first side wall aperture may extend in the first aperture angle towards the second side edge and in the second aperture angle towards the top end of the vertical side wall, and the second side wall aperture may extend in the first aperture angle towards the first side edge and in the second aperture angle towards the bottom end of the vertical side wall. Accordingly, in this embodiment the first and second side wall apertures extend in different directions in relation to horizontal and vertical direction.

In a yet further embodiment of the invention, the first side wall aperture may extend in the first aperture angle towards the first side edge and in the second aperture angle towards the bottom end of the vertical side wall, and the second side wall aperture may extend in the first aperture angle towards the second side edge and in the second aperture angle towards the top end of the vertical side wall. Accordingly, also in this embodiment the first and second side wall apertures extend in different directions in relation to horizontal and vertical direction.

In one embodiment, one or more shelf supports may comprise a stopping surface provided to the support part. The pin part may protrude from the stopping surface. The stopping surface may be further arranged against the side wall surface such that the pin part is inserted into the side wall aperture and that the pin part may extend from the stopping surface in the pin angle in relation to a direction perpendicular to the stopping surface.

In an alternative embodiment, the pin part may extend into the side wall aperture in the pin angle in relation the to a direction perpendicular to side wall surface.

In another embodiment, the one or more shelf supports may comprise a stopping surface provided to the support part. The pin part may protrude from the stopping surface. The stopping surface may be arranged against the side wall surface such that the pin part is inserted into the side wall aperture. The pin part may further extend from the stopping surface in the pin angle in relation to a direction perpendicular to the stopping surface. In this embodiment, the side wall surface may be parallel to the stopping surface.

In a yet further embodiment of the invention, the one or more shelf supports may comprise a stopping surface provided to the support part. The pin part may protrude from the stopping surface. The stopping surface may be arranged against the side wall surface such that the pin part is inserted into the side wall aperture. The pin part may further extend from the stopping surface in the pin angle in relation to a direction perpendicular to the stopping surface. In this embodiment, the side wall surface is parallel to the stopping surface, and the pin angle in relation to a direction perpendicular to the stopping surface corresponds the aperture angle in relation to the direction perpendicular to the side wall surface.

In one embodiment of the present invention, the pin angle, or the first pin angle, or the second pin angle may be between 5 to 60 degrees, or 5 to 45 degrees, or 5 to 25 degrees, or 7 to 20 degrees. In one specific embodiment, the pin angle, or the first pin angle, or the second pin angle may be between 7 to 18 degrees, preferably between 8 to 16 degrees, or more preferably between 10 to 15 degrees.

When the pin parts 20 and the side wall apertures extend in different directions they provide firm locking of the shelf support to the side wall.

In one embodiment, the support part may comprise a protrusion protruding upwards from an upper support surface arranged to be positioned towards the shelf plate. The protrusion may be provided to the support part at a first distance from the stopping surface and arranged into a support hole provided to a bottom surface of the shelf plate.

In another embodiment, the support part may comprise a protrusion protruding upwards from an upper support surface arranged to be positioned towards the shelf plate. The protrusion is provided to the support part at a first distance from the stopping surface and arranged into a support hole provided a bottom surface of the shelf plate. The protrusion comprises a retaining surface extending transversely to the direction perpendicular to the side wall surface. The support hole comprises a counter surface provided between the side wall surface and the retaining surface. The retaining surface is placed against the counter surface.

The protrusion and the support hole together secure the shelf plate in the direction parallel to the shelf plate. Furthermore, the protrusion and the support hole together with the oblique angle extending side wall aperture and pin part, may wedge and secure the shelf plate to the vertical side walls.

The shelf support with the oblique angle protruding pin part and the arrangement of the present invention provide an easy to install and effective securing of the shelf plate to the vertical side walls of the shelf. The present invention removes the need for using tools or additional fasteners to securing the shelf plate to the side walls. The shelf plate may be secured in tight manner to the side walls and the shelf plate may further be removed or detached without causing any permanent damages to the sides walls or to the side wall apertures. The combination of the oblique pin parts, oblique side wall aperture and the protrusion enable excellent securing of the shelf plate. The positioning of the shelf support may be enhanced with the stopping surface preventing the shelf support with oblique pin part from turning in the oblique ide wall aperture. Furthermore, the connection of the shelf late to the side walls is further enhanced when the adjacent side wall apertures extend in different directions, for example towards each other or away from each other. The when the adjacent side wall apertures extend in different directions, a drawing force is formed between the shelf support and between the shelf supports and the shelf plate.

BRIEF DESCRIPTION OF THE DRAWINGS

The invention is described in detail by means of specific embodiments with reference to the enclosed drawings, in which.

DETAILED DESCRIPTION OF THE INVENTION

Figure 1C:
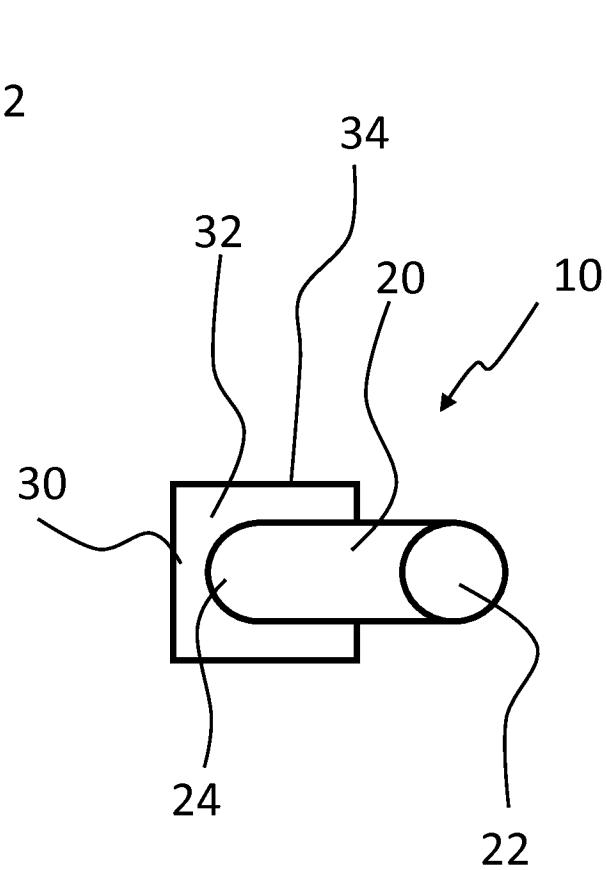
FIG. 1*c* shows the shelf support shown in FIG. 1*a* as a front view seen from front of a pin part.
Figure 1A:
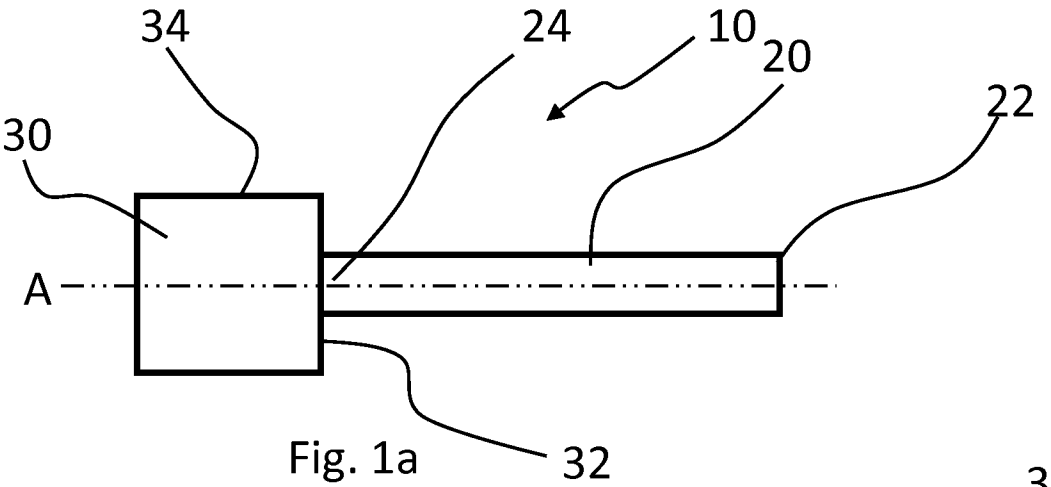
FIG. 1*a* shows one embodiment of a shelf support according to the invention as a side view.
Figure 1B:
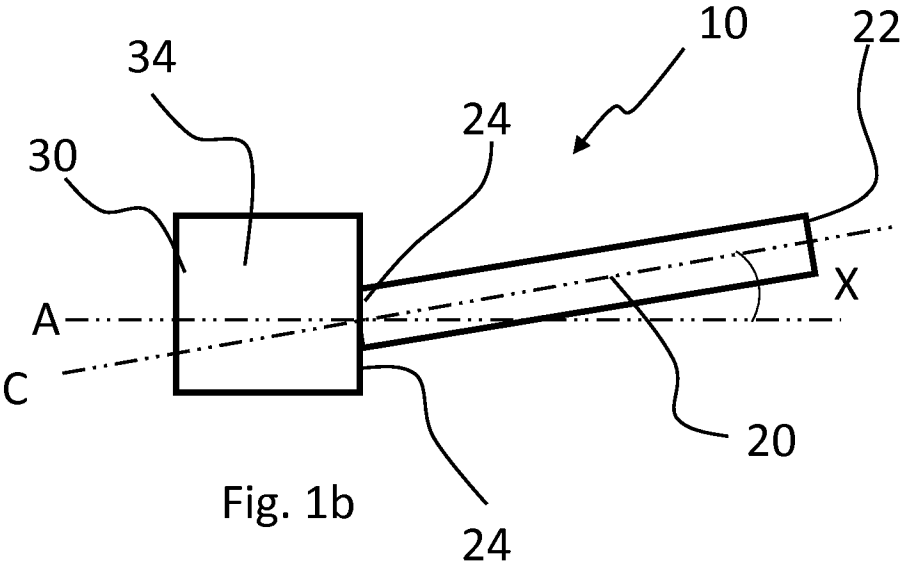
FIG. 1*b* shows the shelf support shown in FIG. 1*a* as a top view.

FIG. 1*a* shows a side view of one embodiment of a shelf support 10 according to the invention. The shelf support is formed for supporting a shelf plate to a side wall of a shelf from the lateral side edges of the shelf plate or from the lateral side edge areas. The shelf support 10 arranged to be installed into a side wall aperture provided to a side wall surface of the side wall. As shown in FIG. 1*a*, the shelf support 10 comprises a support part 30 arranged to extend outside of the side wall aperture. The shelf plate is supported on the support part 30. The support part 30 comprises an upper surface 34 arranged to be positioned towards the shelf plate. The shelf plate 50 is supported on or against the upper support surface 34. In normal use, the upper support surface 34 faces upwards towards the shelf plate or the bottom surface of the shelf plate. The support part 30 further comprises a stopping surface 32, which extends transversely or perpendicularly to the upper support surface 34. In FIGS. 1*a*, 1*b* and 1*c*, the support part 30 is a cube, however, it may be plate, bar, trip, hemisphere, round part or any other kind of part extending outside the side wall aperture.

The shelf support 10 further comprises the pin part 20 protruding from the stopping surface 32 arranged to be inserted into the side wall aperture. The pin part has a proximal end 24 from which it is connected to the stopping surface 32, and a distal end 22 away from the stopping surface 32. The pin part 20 is pin with circular cross-section. However, the pin part 20 may be any kind of pin having circular, rectangular, oval or polygonal cross-section. The length and thickness of the pin part 20 may vary depending on the size of shelf of the size of the shelf plate.

The stopping surface 32 may be any surface having larger dimensions than the side wall aperture in which the pin part 20 is inserted such that the stopping surface 32 prevents the support part 30 of entering the side wall aperture. Preferably the stopping surface 32 extends at least in vertical direction, or in the direction between the bottom end and the top end, of the side wall surface, meaning upwards and/or downwards from the pin part 20 when the upper support surface faces upwards.

As shown in FIGS. 1*b* and 1*c*, the pin part 20 extends from the stopping surface 32 in a first pin angle X in relation to a direction A perpendicular to the stopping surface 32. FIG. 1*b* shows a top view of the shelf support 10 with the first pin angle X. The FIG. 1*c* is a front view of the shelf support. Accordingly, the pin part 20 extends from the stopping surface 32 parallel to the upper support surface 34 and in the first pin angle X in relation to the direction A perpendicular to the stopping plane 32 when the shelf support 10 is viewed from the support part 30 towards the pin part 20. It may also be defined, that the upper support surface 34 defines an upper support plane, and the pin part 20 extends from the stopping surface 32 in a direction parallel to the upper support plane and in the first pin angle X in relation to the direction A perpendicular to the stopping plane. The latter is the case, when the upper support surface 34 is not smooth or a planar itself.

The first pin angle X is between 7 to 20 degrees, preferably between 7 to 18 degrees, or about 15 degrees in relation to the direction A perpendicular to the stopping surface 32 or plane.

Figure 2C:
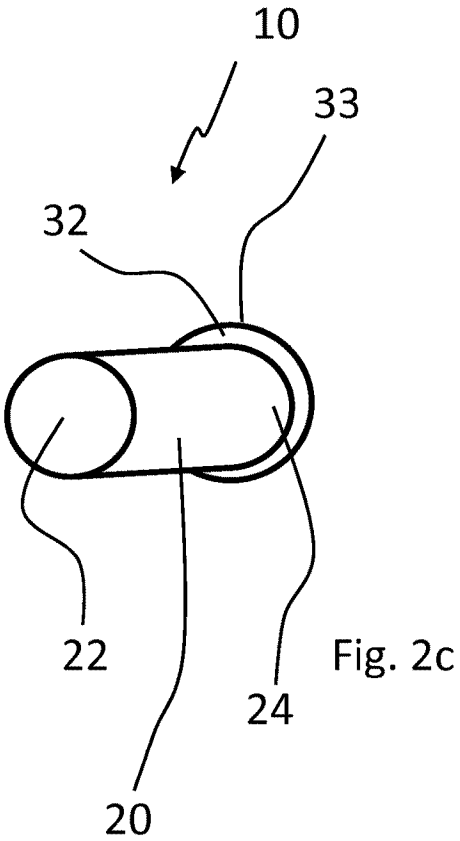
FIG. 2*c* shows the shelf support shown in FIG. 2*a* as a front view seen from front of a pin part
Figure 2A:
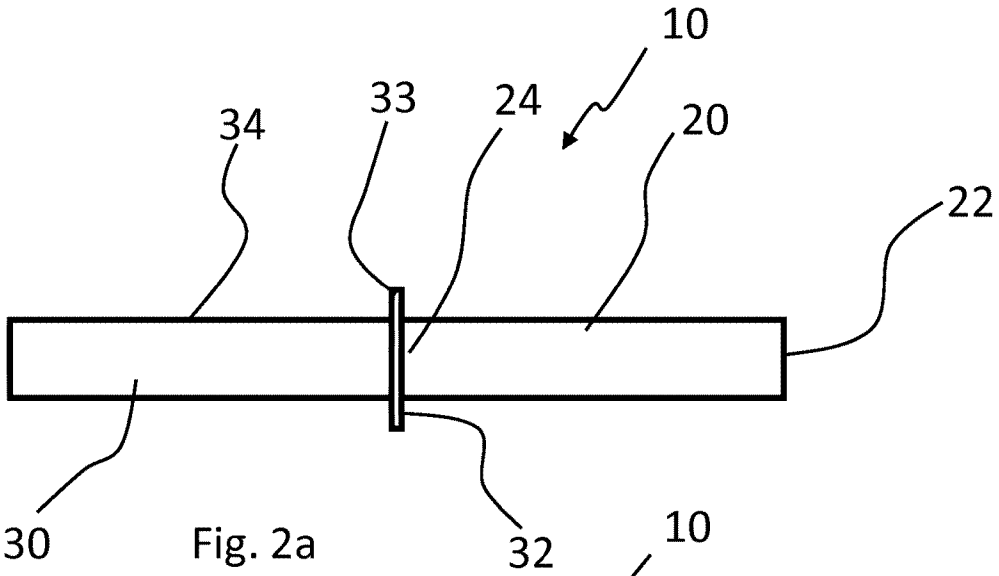
FIG. 2*a* shows another embodiment of a shelf support according to the invention as a side view.
Figure 2B:
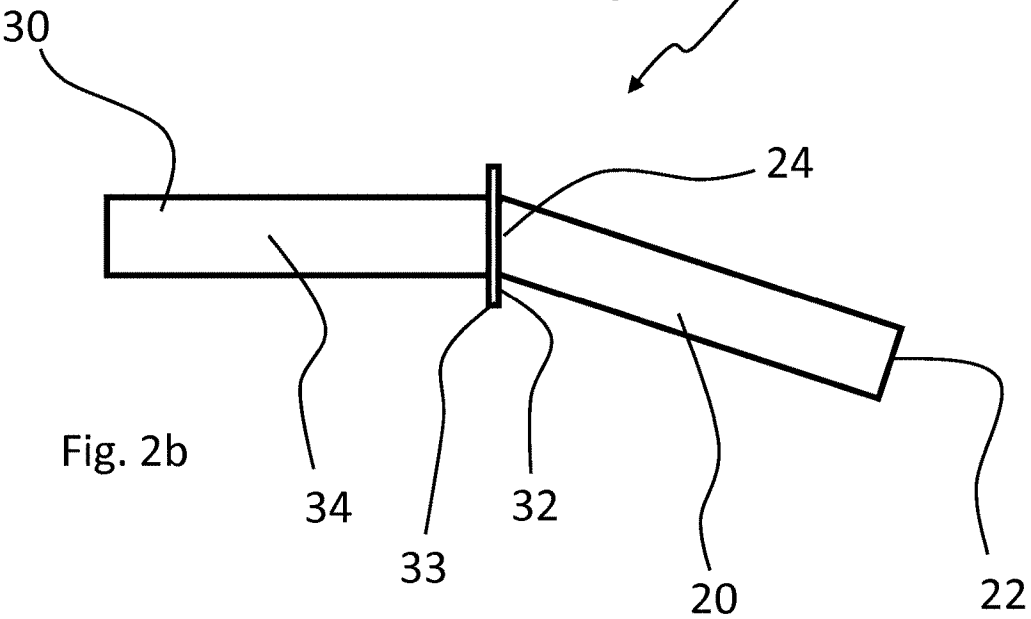
FIG. 2*b* shows the shelf support shown in FIG. 2*a* as a top view.

FIG. 2*a* shows a side view of another shelf support 10 having the support part 30 and the pin part 20. The support part 30 comprises a collar 33 extending transversely or perpendicularly to the support part 30 and/or the pin part 20. The collar 33 forms the stopping surface 32 and the pin part 20 protrudes from the stopping surface 32 of the collar 33. In this embodiment, the pin part 20 and the support part 30 are both similar parts but they extend in the first pin angle X in relation to each other, as shown in FIGS. 2*b* and 2*c*. The pin part 20 and the support part 30 both are longitudinal and have circular cross-section. In this embodiment, the upper most line of the support part 30 forms the upper support surface 3, as shown in FIGS. 2*a* and 2*b*.

Figure 3:
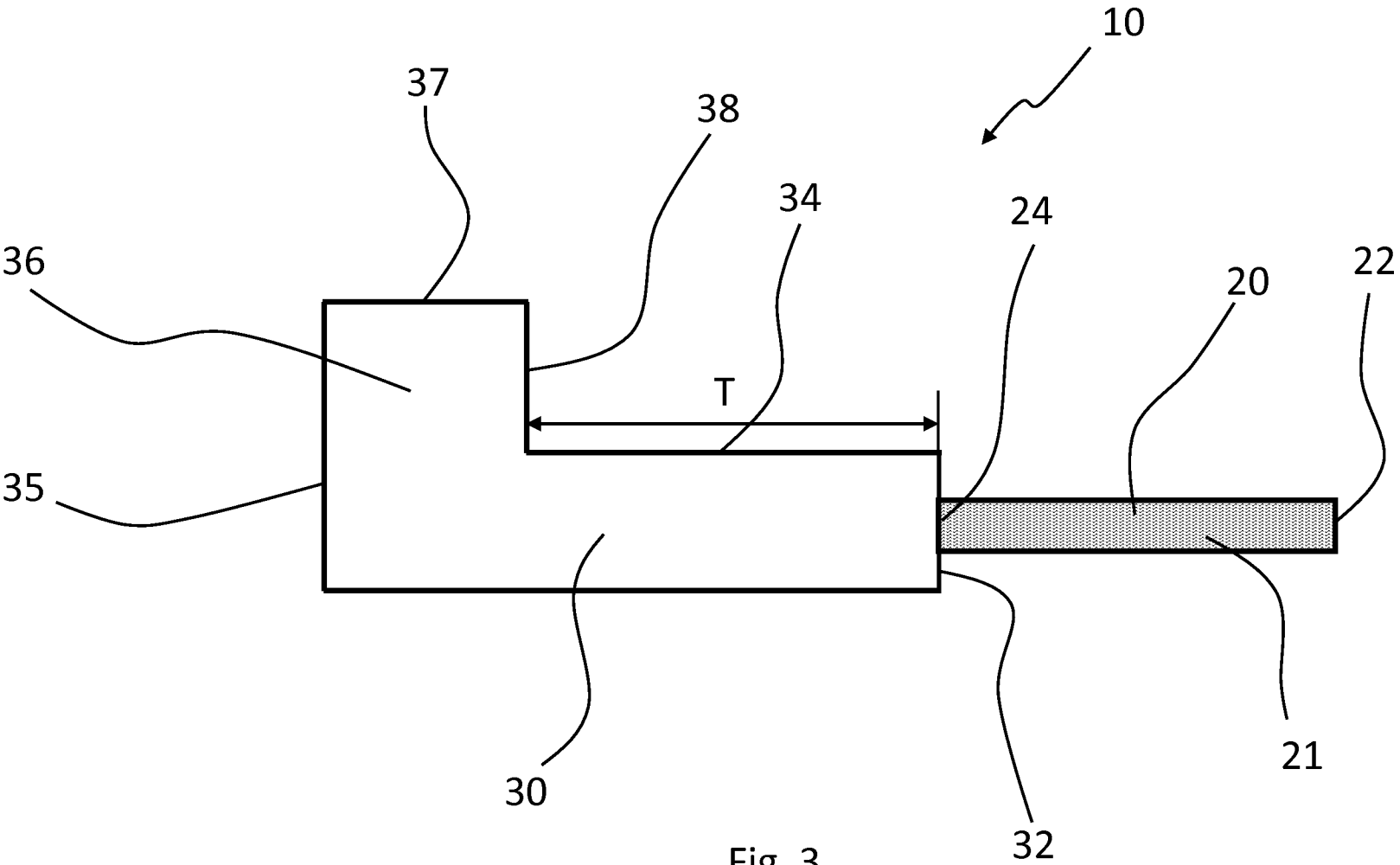
FIG. 3 shows yet another embodiment of a shelf support according to the invention as a side view.

FIG. 3 shows, an alternative embodiment of the shelf support 10. IN this embodiment, the pin part 20 has roughening 21 or projections making the surface of the pin part 20 uneven. The roughening 21 increases friction between the pin part 20 and the inner surface of the side wall aperture keeping the pin part 20 more tightly inside the side wall aperture. The roughening may be utilized in any embodiment of the invention.

The shelf support 10 of FIG. 3 further comprise the stopping surface 32 and the pin part 20 extends from the stopping surface 32 of the support part 30. The support part 30 also comprises the upper support surface 34 which faces upwards and towards the shelf plate during normal use. As seen in FIG. 3, the support part 30 extends between the stopping surface 32 and the support part end 35. The support part 30 is further provided with a protrusion 36 protruding from the upper support surface 34, preferably upwards or perpendicularly from the upper support surface 34. The protrusion 36 is provided to the support part 30 at a distance T from the stopping surface 32. In this case, the shelf plate also has a support hole for receiving the protrusion 36. The support hole may be provided to the bottom surface of the shelf plate and in the first distance T from the lateral side edge of the shelf plate which is placed against the vertical side wall surface. The protrusion 36 comprises a retaining surface 38 extending in transverse direction in relation to the direction A perpendicular to the stopping surface 32 and upwards from the upper support surface. Alternatively, the retaining surface 38 may extend parallel to the stopping surface 32 and upwards from the upper support surface 36. The retaining surface 38 faces towards the pin part 20. The protrusion 36 also comprises an upper protrusion support surface 37 which is arranged to be provided towards the shelf plate, and against which the shelf plate may be supported. The upper protrusion support surface 37 may extend parallel to the upper support surface 34 or transversely or perpendicularly to the stopping surface 32. The upper protrusion support surface 37 may be arranged against bottom surface of the support hole of the shelf plate.

Figure 4:
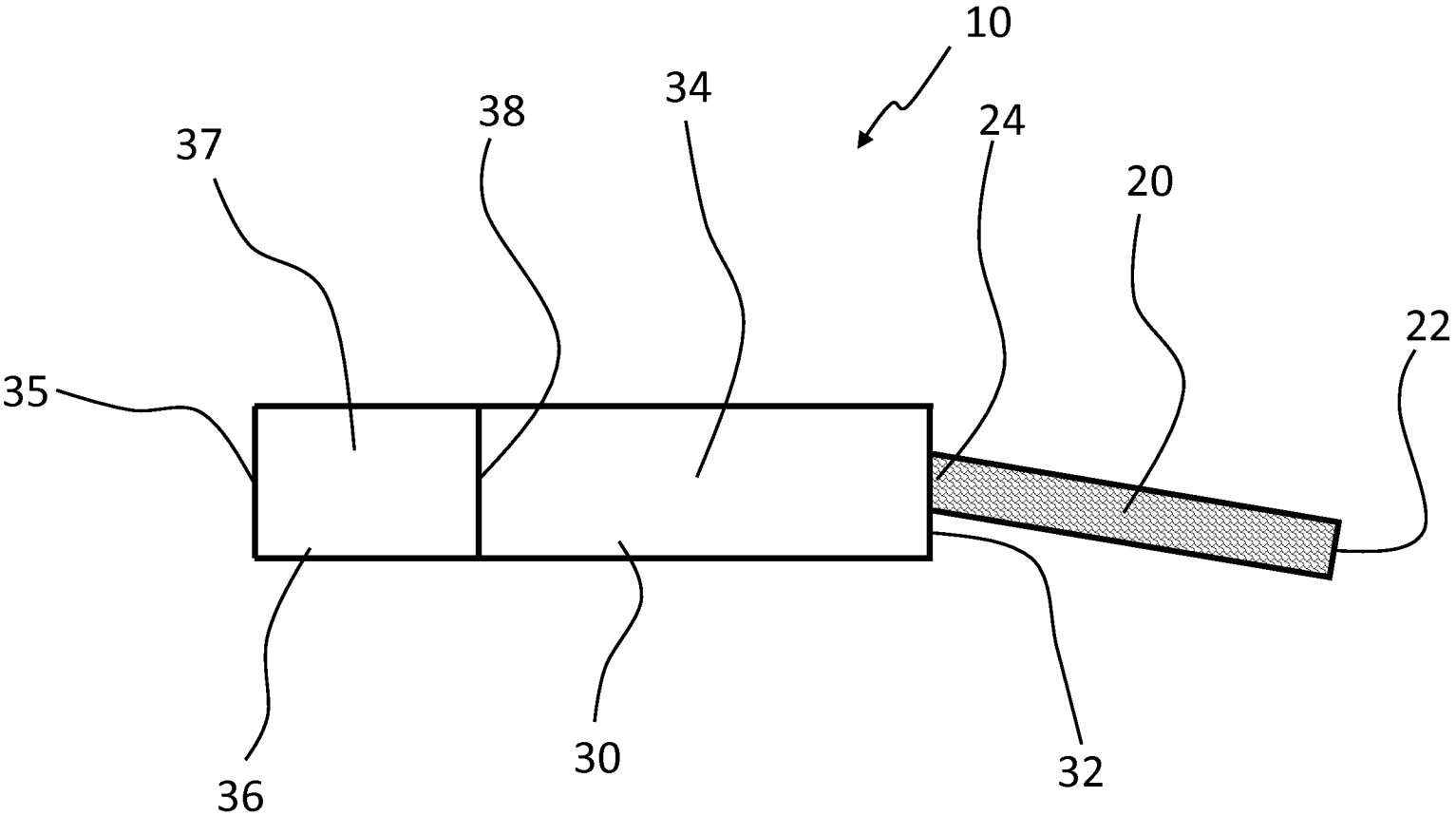
FIG. 4 shows the shelf support shown in FIG. 3 as a top view.

FIG. 4, shows an upper view of the shelf support of FIG. 3. As shown in FIGS. 3 and 4, the pin part 20 extends from the stopping surface 32 in a plane parallel to the upper support surface 34 and in the first pin angle X in relation to the direction A perpendicular to the stopping plane 32. The stopping surface 32 may define a stopping plane and the support part 30 may comprise the upper support surface 34, 37 arranged towards the shelf plate. The upper support surface 34, 37 may further define an upper support plane perpendicular to the stopping plane. Thus, the pin part 20 may extend from the stopping surface 32 in a direction parallel to the upper support plane and in the first pin angle X in relation to a direction A perpendicular to the stopping plane.

Figure 5:
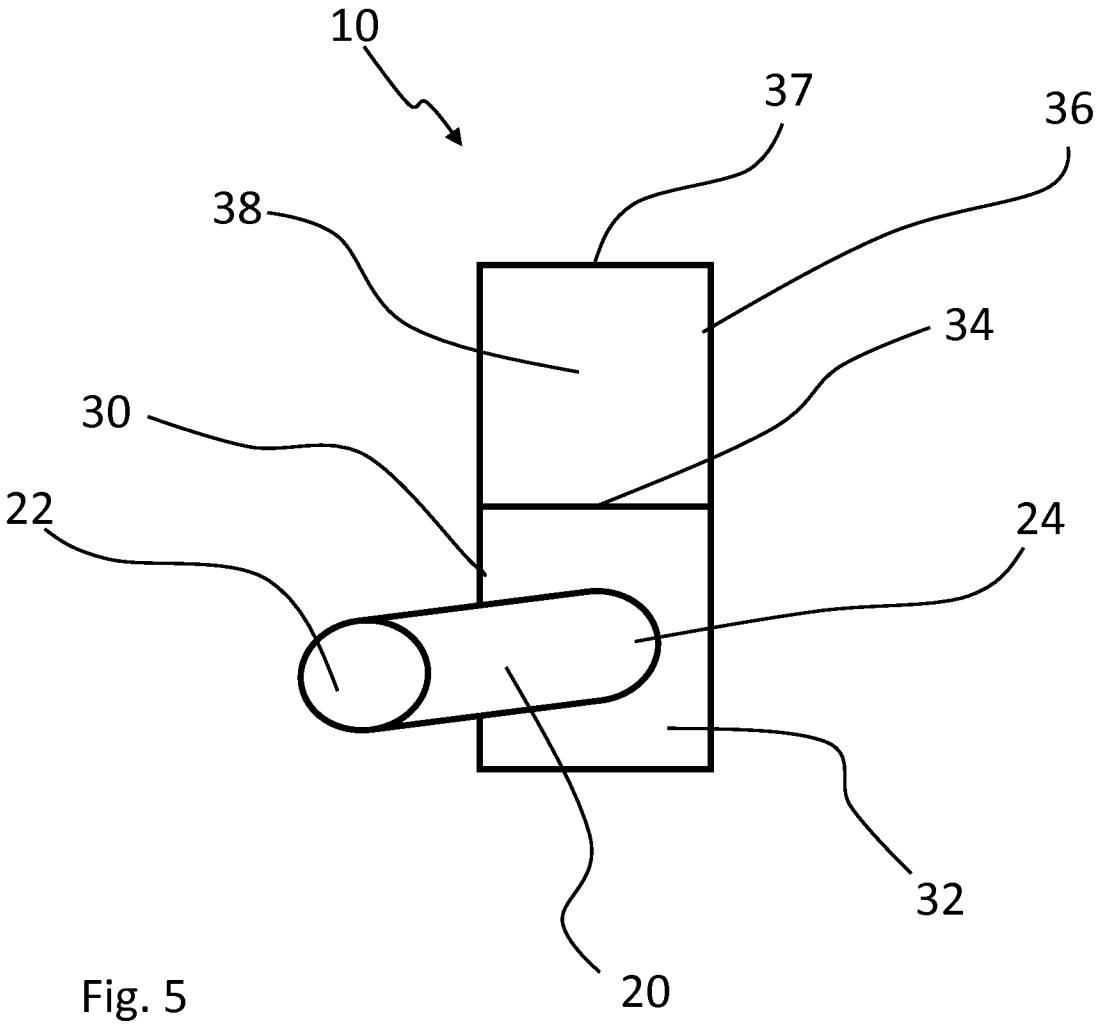
FIG. 5 shows the shelf support shown in FIG. 3 as a front view seen from front of a pin part.

FIG. 5 shows the shelf support of FIGS. 3 and 4 in a front view. FIGS. 3, 4 and 5 show, that the pin part 20 extends from the stopping surface 32 parallel to the upper support surface 34 and in the first pin angle X in relation to the direction A perpendicular to the stopping plane 32 when the shelf support 10 is viewed from the support part 30 towards the pin part 20. Accordingly, it may be seen means that the pin part 20 extends from the stopping surface 32 in laterally oblique angle, left or right, in relation to the direction perpendicular to the stopping surface 32 or stopping plane. Furthermore, the pin part 20 may be defined to protrude from the stopping surface 32 horizontally and in the oblique angle, or first pin angle X, when the shelf support 10 is in normal use position the upper support 34 facing upwards.

Figure 12:
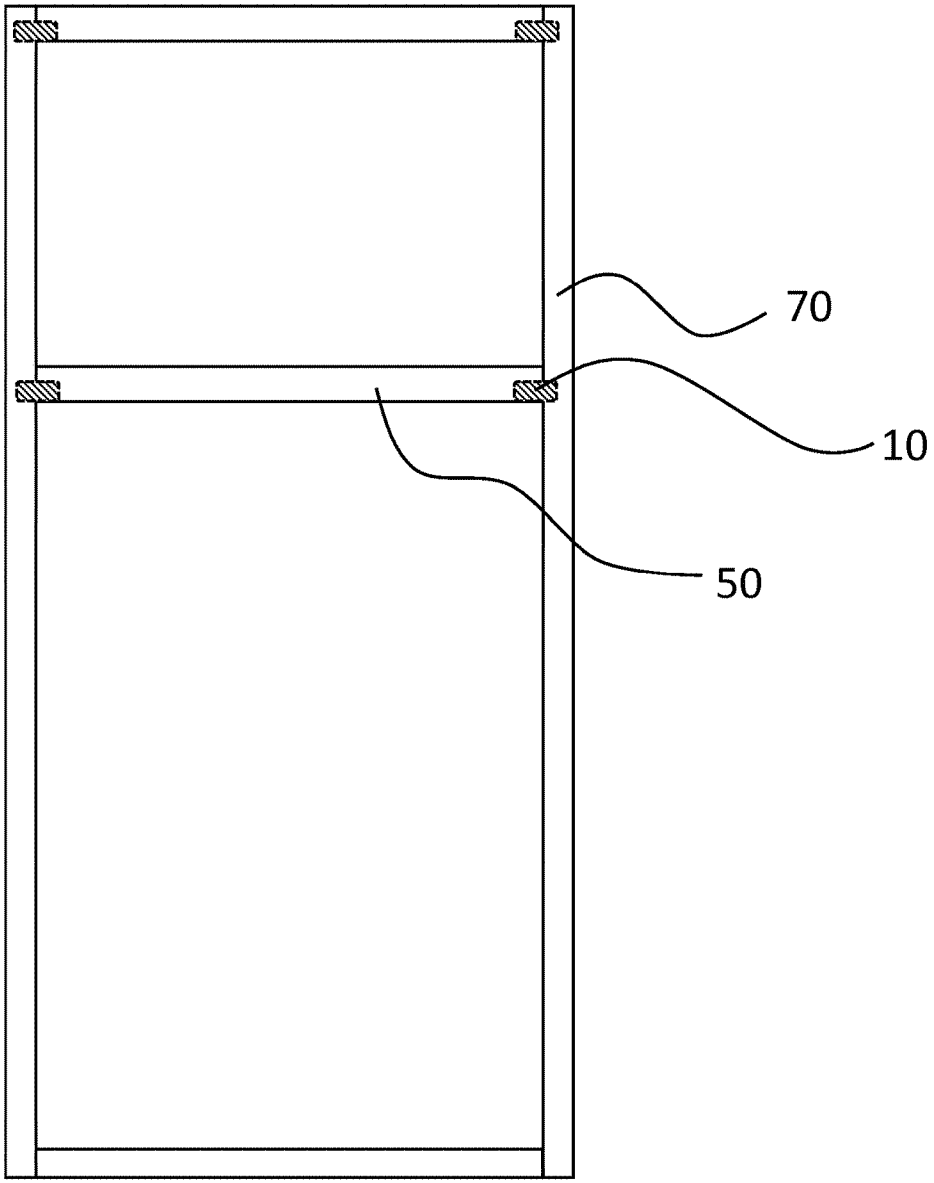
FIG. 12 shows a shelf arrangement according to the invention.
Figure 13:
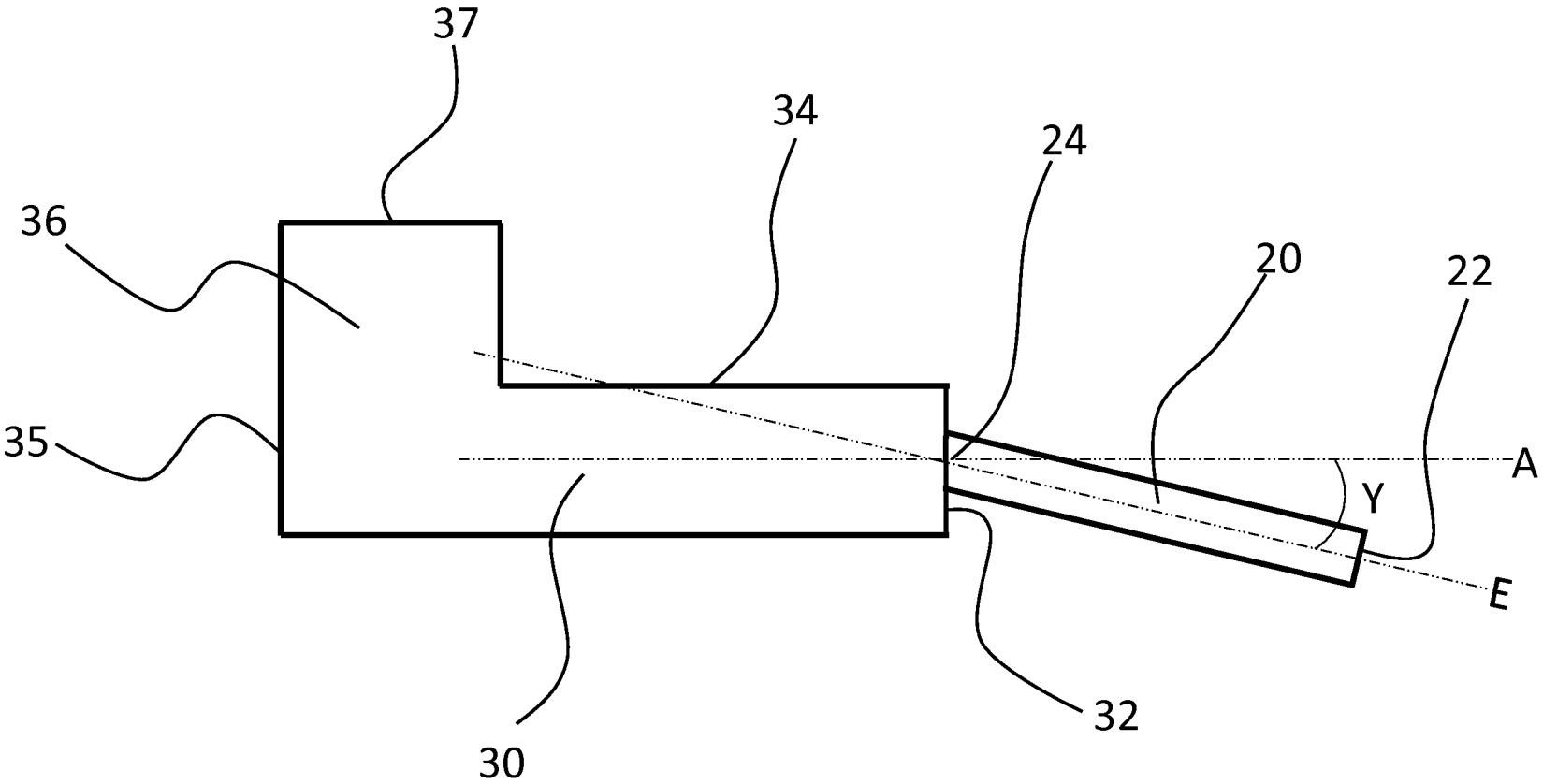
FIG. 13 shows a shelf support according to the invention as a side view.

FIG. 12 shows an alternative embodiment in which the pin part 20 extends from the stopping surface 32 downwards, or upward, in relation to the upper surface 34, 37 and in the second pin angle Y in relation to the direction A perpendicular to the stopping plane 32 when the shelf support 10 is viewed from the support part 30 towards the pin part 20. In other words, the pin part 20 may extend from the stopping surface 32 upwards or downwards in relation to the upper support plane in the second pin angle Y in relation to the direction A perpendicular to the stopping plane. Further, the pin part 20 may extend from the stopping surface 32 in the second pin angle Y in relation to the direction A parallel to a plane perpendicular to the stopping plane and the upper support plane.

Figures 6A, 6B, 6C:
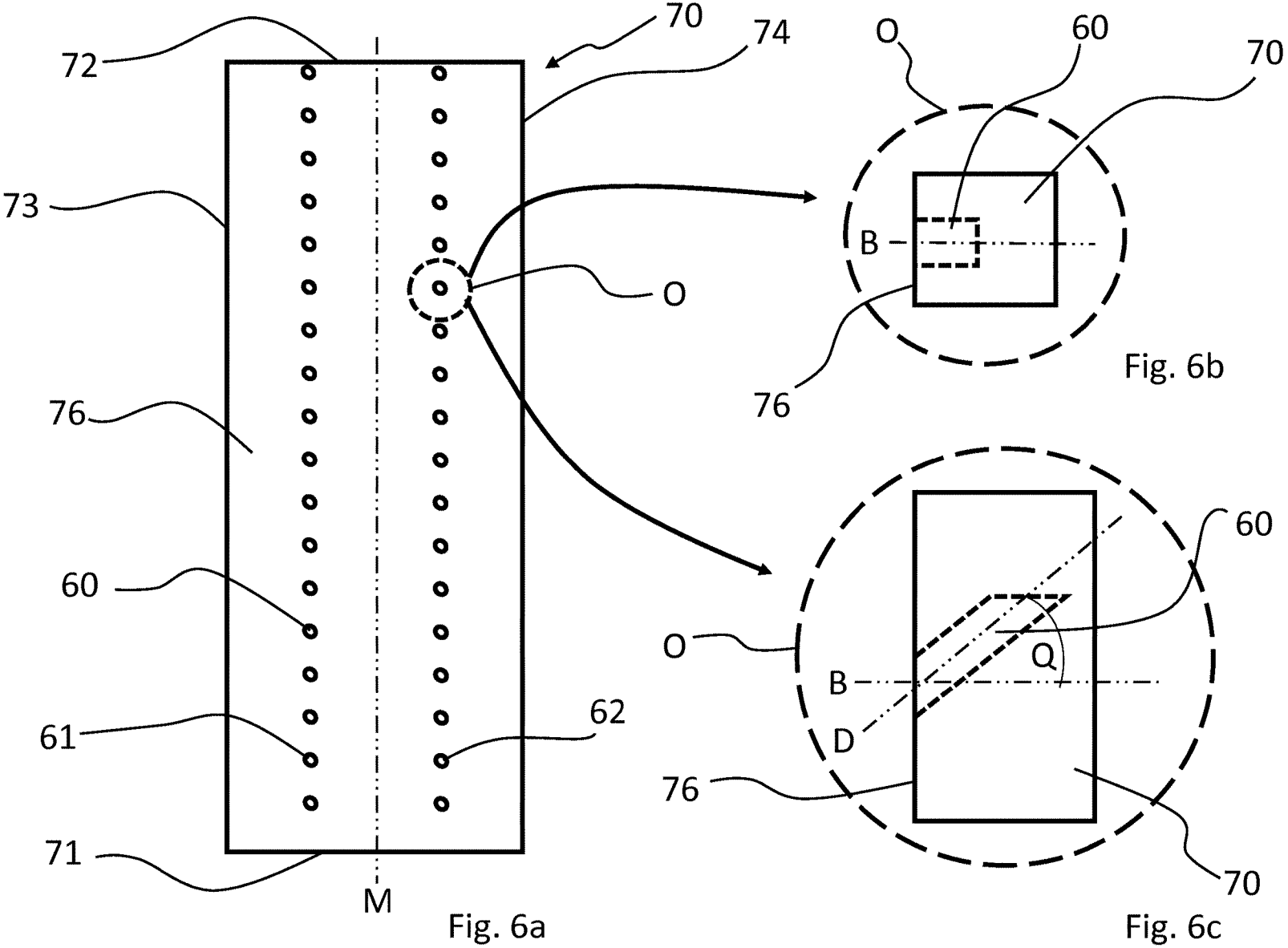
FIG. 6*a* shows an embodiment of a side wall as a front view.
FIG. 6*b* shows a detail of the side wall shown in FIG. 6*a* as a front view.
FIG. 6*c* shows a detail of the side wall shown in FIG. 6*a* as a side view.
Figure 7:
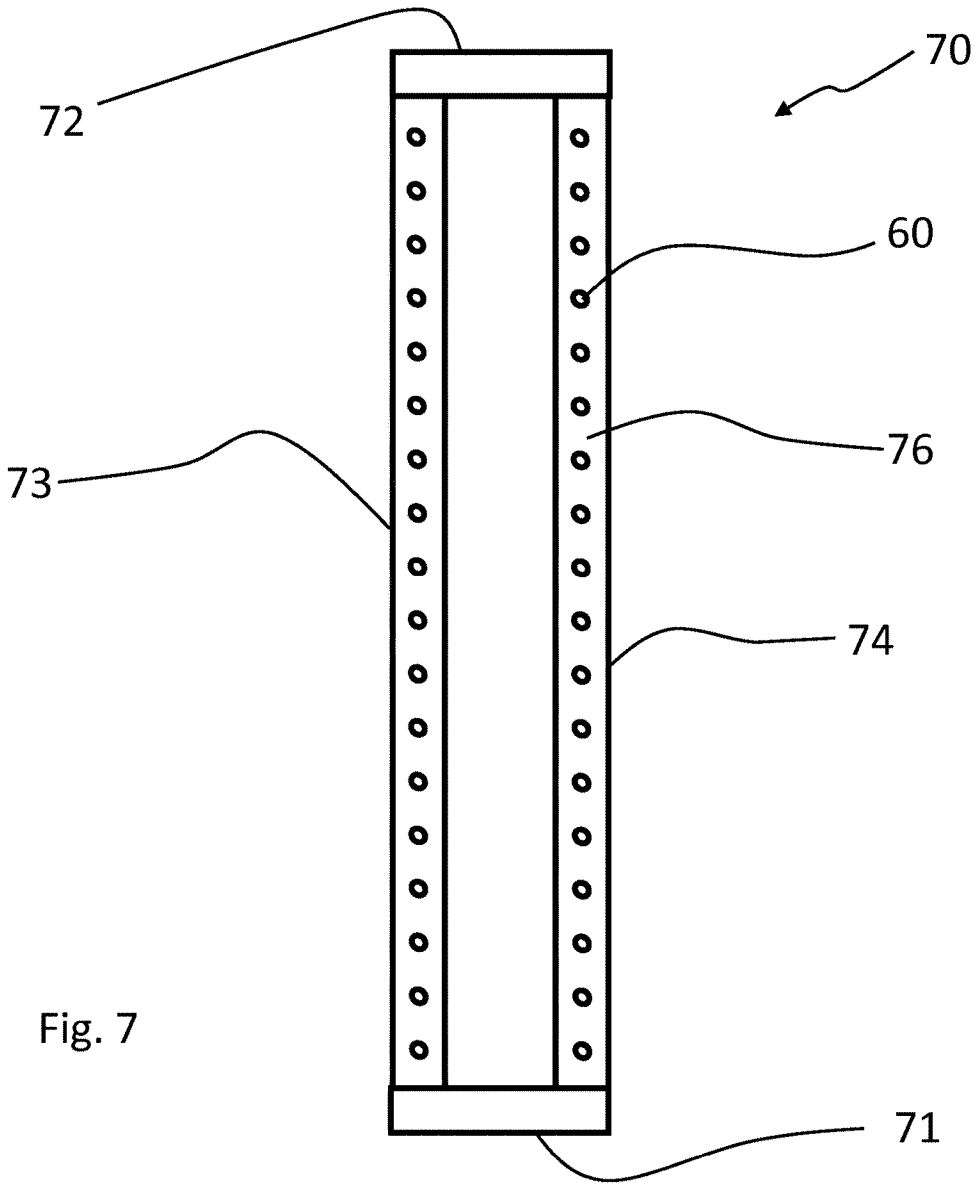
FIG. 7 shows another embodiment of a side wall as a front view.

FIG. 6*a* shows a vertical side wall 70 of a shelf. The vertical side walls 70 comprising a bottom end 71, a top end 72, a first side edge 73, a second side edge 74 and a side wall surface 76 provided between the bottom and top ends 71, 72 and the first and second side edges 73, 74. The FIG. 6 shows a vertical side wall 70 having solid side wall surface 76. However, the vertical side wall 70 may also be frame-like side wall having open surface area, as shown in FIG. 7. Alternative, the vertical side wall may comprise or consist of rails. These kinds of vertical side walls, the frames or rails or the like form the side wall surface 76, as shown in FIG. 7.

The side wall surface 76 comprises one or more side wall apertures 60 provided to the side wall surfaces 76 of the vertical side walls 70. The side wall apertures 60 extend from the side wall surface 76 into the vertical side walls 70. The vertical side wall 70 has a longitudinal direction M extending between the bottom end 71 and the top end 72. The shelf supports 10 may are arranged inside the side wall apertures 60 such that the support part 30 protrudes outside of the side wall aperture 60 from the side wall surface 76 and the pin part 20 is inside the side wall aperture 60.

The side wall surface 76 usually, as in FIGS. 6*a* and 7, comprises at least one pair of adjacent side wall apertures 60. The pair of adjacent side wall apertures 60 comprise a first side wall aperture 61 and a second side wall aperture 62 arranged adjacent to each other for supporting on shelf plate. As in the FIGS. 6*a* and 7, the side wall surface 76 usually comprises two or more pairs of the side wall apertures 60, 61, 62 arranged successively between the bottom end 71 and top end 72 of the vertical side wall 70.

FIG. 6*b* shows a detail O of FIG. 6*a*. The FIG. 6*b* shows the vertical side wall 70 as a side view. The side wall aperture 60 extend from the side wall surfaces 76 into the vertical side walls 70 in horizontal direction. However, FIG. 6*c* shows a top view of the detail O of FIG. 6*a*. The side wall aperture 60 extends into the side wall 70 in direction D and in angle Q in relation to a direction B perpendicular to the side wall surface. Accordingly, the side wall aperture 60 extends inside the side wall 70 in horizontal direction and towards the first or second side edge 73, 74 of the vertical side wall.

In other words, the vertical sides wall 70 comprises a vertical cross-sectional plane extending perpendicularly to the side wall surface 76 between the bottom end 71 and the top end 72 and parallel to longitudinal direction M of the one or more side walls 70 between the bottom end 71 and top end 72. The vertical sides wall 70 also comprises a horizontal cross-sectional plane extending perpendicularly to the side wall surface 76 between the first edge 73 and the second edge 74 and perpendicularly to longitudinal direction M of the one or more side walls 70 between the bottom end 71 and top end 72. Thus, the one or more side wall apertures 60 extend parallel to the horizontal cross-sectional plane and in a first aperture angle Q in relation to the vertical cross-sectional plane. Alternatively, the one or more side wall apertures 60 extend parallel to the vertical cross-sectional plane and in a second aperture angle in relation to the horizontal cross-sectional plane. Further, the one or more side wall apertures 60 may also extend in the first aperture angle Q in relation to the vertical cross-sectional plane and in the second aperture angle in relation to the horizontal cross-sectional plane.

Figure 8:
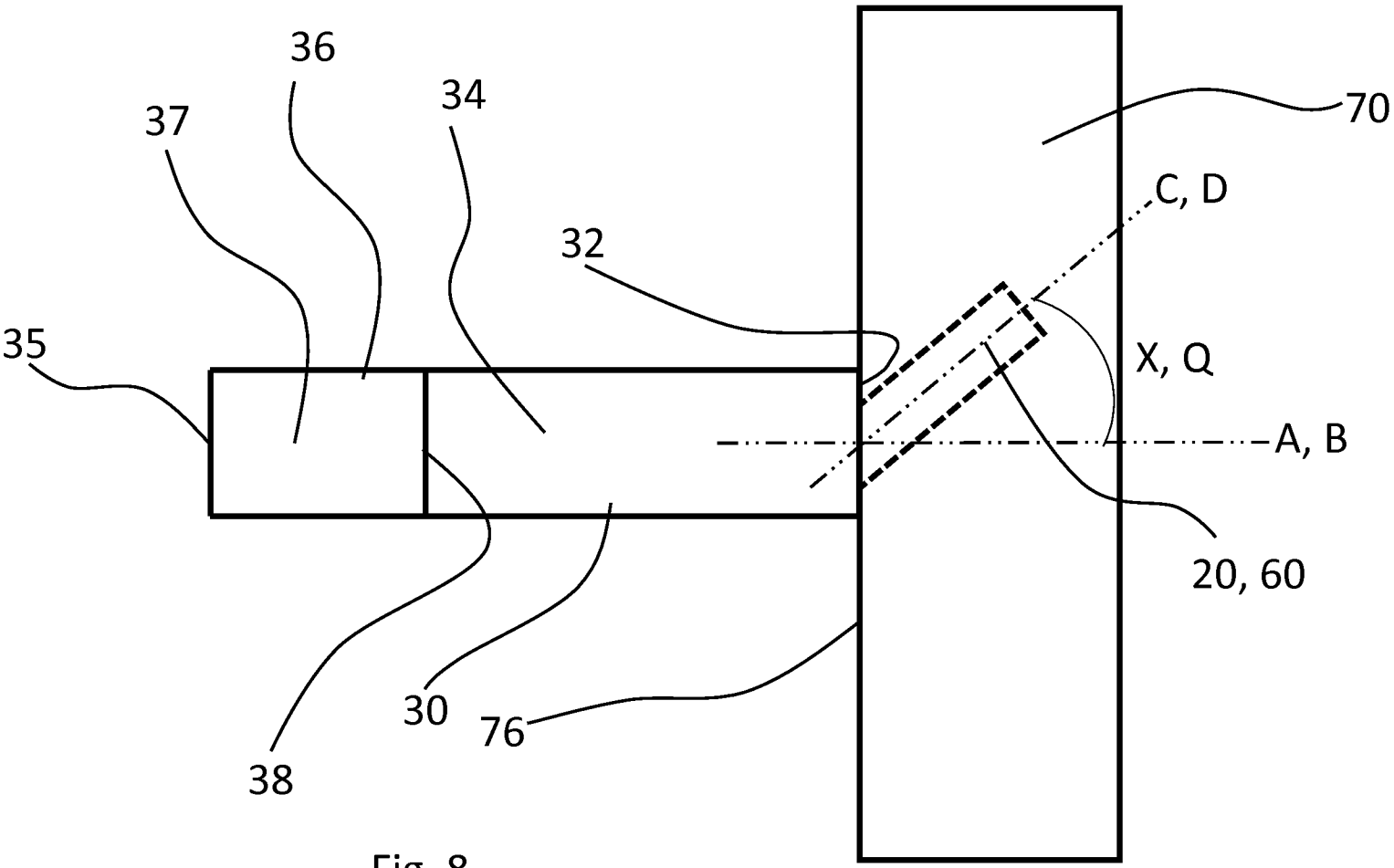
FIG. 8 shows a detail of a shelf support and a side view as a top view.

FIG. 8 shows a top view in which the shelf support 10 attached to the side wall aperture 60 of the vertical side wall 70. As shown, the wall aperture 60 extends from the side wall surfaces 76 into the vertical side walls 70 in an aperture angle Q in relation to the direction B perpendicular to the side wall surface 76. Further, the pin part 20 extends into the side wall aperture 60 from the support part 30 in the pin angle X in relation to the support part 30, or in the pin angle X in relation to the direction A perpendicular to the stopping surface 32.

Figure 10A:
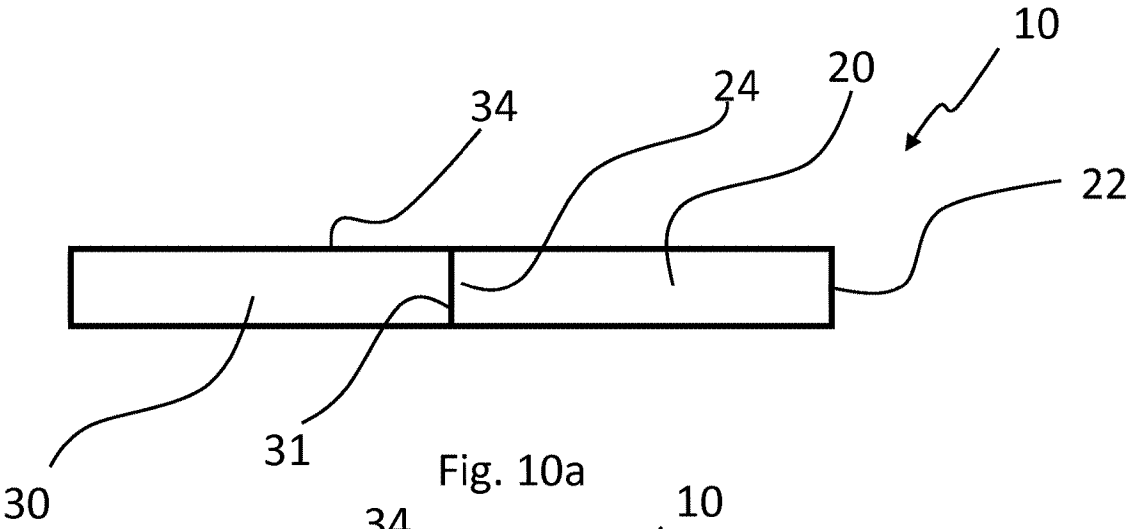
FIG. 10*a* shows still another embodiment of a shelf support according to the invention as a side view.
Figure 10B:
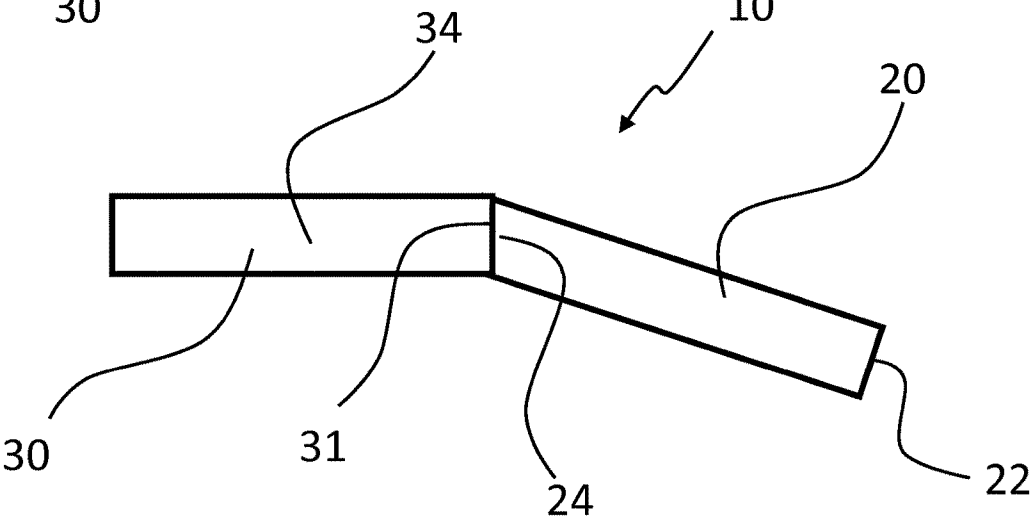
FIG. 10*b* shows the shelf support shown in FIG. 10*a* as a top view.
Figure 10C:
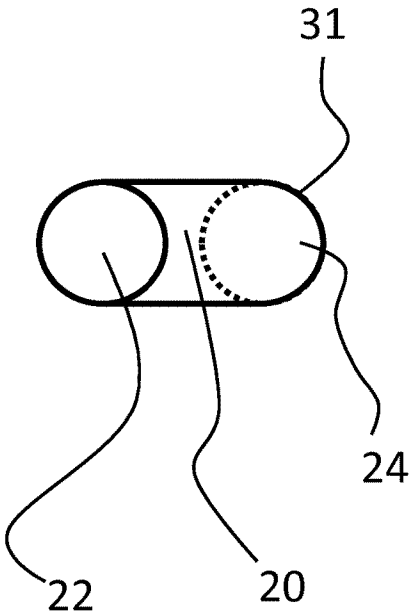
FIG. 10*c* shows the shelf support shown in FIG. 10*a* as a front view seen from front of a pin part.
Figure 11A:
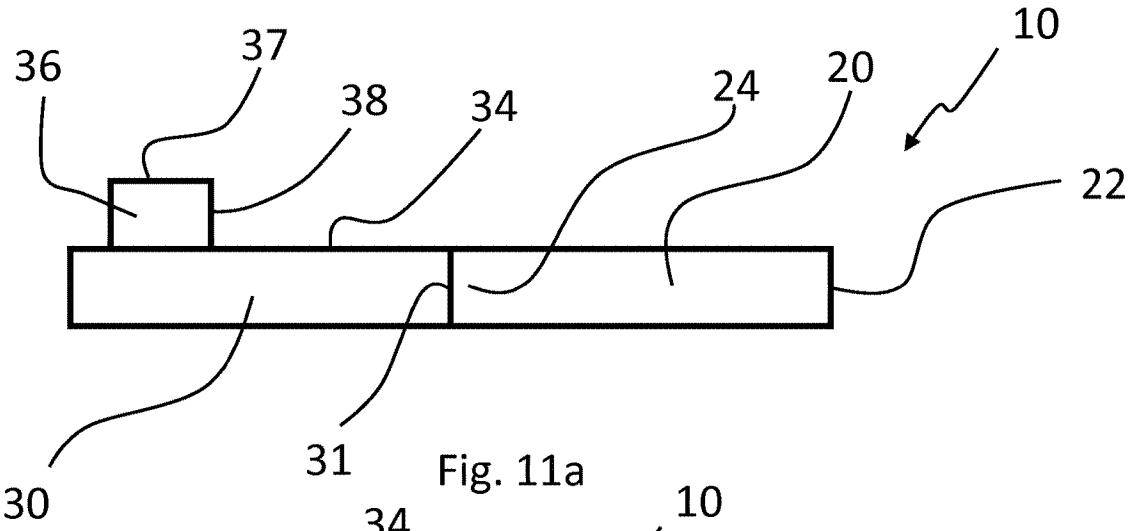
FIGS. 11*a* and 11*b* show the shelf support of FIGS. 10*a*, 10*b* and 10*c* with a protrusion.
Figure 11B:
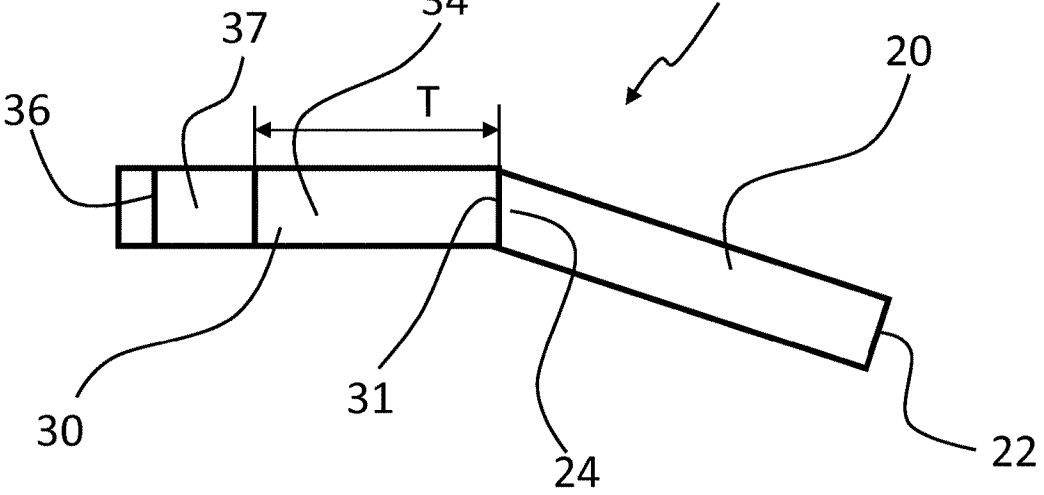

It should be noted, that in this arrangement it may also be used as the shelf support 10 a pin uniform cross section, as shown in FIGS. 10*a*, 10*b* and 10*c*. This shelf support comprises the pin part 20 and the support part 20, and they extend in the first pin angle X in relation to each other. The shelf support 10 in this embodiment comprise corner 31 forming the pin angle. The pin angle may be as described above. FIGS. 11*a* and 11*b* show an alternative embodiment in which the support part 30 comprises the protrusion 36 at the first distance T from the corner 31. The combination of the oblique side wall aperture, shelf support with the corner 31 and the protrusion form a solution which enables locking or securing the shelf plate efficiently to the side walls. Thus, the shelf plate is secured both in direction of the side edges 53, 54 and in a direction perpendicular to the side edges 53, 54.

The support part 30 may protrude from the side wall surface 76 in the direction B perpendicular to the side wall surface 76. The aperture angle Q corresponds the pin angle X, when the stopping surface 32 is parallel to the side wall surface 76 and against the side wall surface 76. This means the direction of the side wall aperture 60 in relation to the side wall surface 76 corresponds direction of the pin part 20 in relation to the stopping surface 32.

In a case the stopping surface 32 is not parallel to the side wall surface 76, the pin part 20 is inside the side wall aperture, the aperture angle Q may differ from the pin angle X.

The first aperture angle may be between 7 to 20 degrees, preferably between 7 to 18 degrees, or about 15 degrees in relation to the direction B perpendicular to the side wall surface 76.

As mentioned above, the side wall surfaces 76 may comprise at least one pair of adjacent side wall apertures 60, the pair of adjacent side wall apertures 60 comprise the first side wall aperture 61 and the second side wall aperture 62. In one embodiment, the first side wall aperture 61 extends parallel to the horizontal cross-sectional plane and in the first aperture angle X towards the second side edge 74 of the vertical side wall 70, and the second side wall aperture 62 extends parallel to the horizontal cross-sectional plane and in the first aperture angle Q towards the first side edge 73 of the vertical side wall 70. Alternative, the first side wall aperture 61 extend parallel to the horizontal cross-sectional plane and in the first aperture angle towards the first side edge 74 of the vertical side wall 70, and the second side wall aperture 62 may extend parallel to the horizontal cross-sectional plane and in the first aperture angle Q towards the second side edge 73 of the vertical side wall 70. In other word, the first and second side wall aperture 61, 62 extends in different directions towards each other or away from each other. Similarly, the pin parts 20 of the shelf supports 10 extend in the first pin angle X towards each other or away from each other inside the first and second side wall apertures 61, 62.

In the case of using the shelf support 10 of FIG. 12 and using side wall apertures 60 extending in different direction towards the top end 72 and bottom end 72 of the vertical side wall 70, the same may be achieved.

Figures 9A, 9B, 9C:
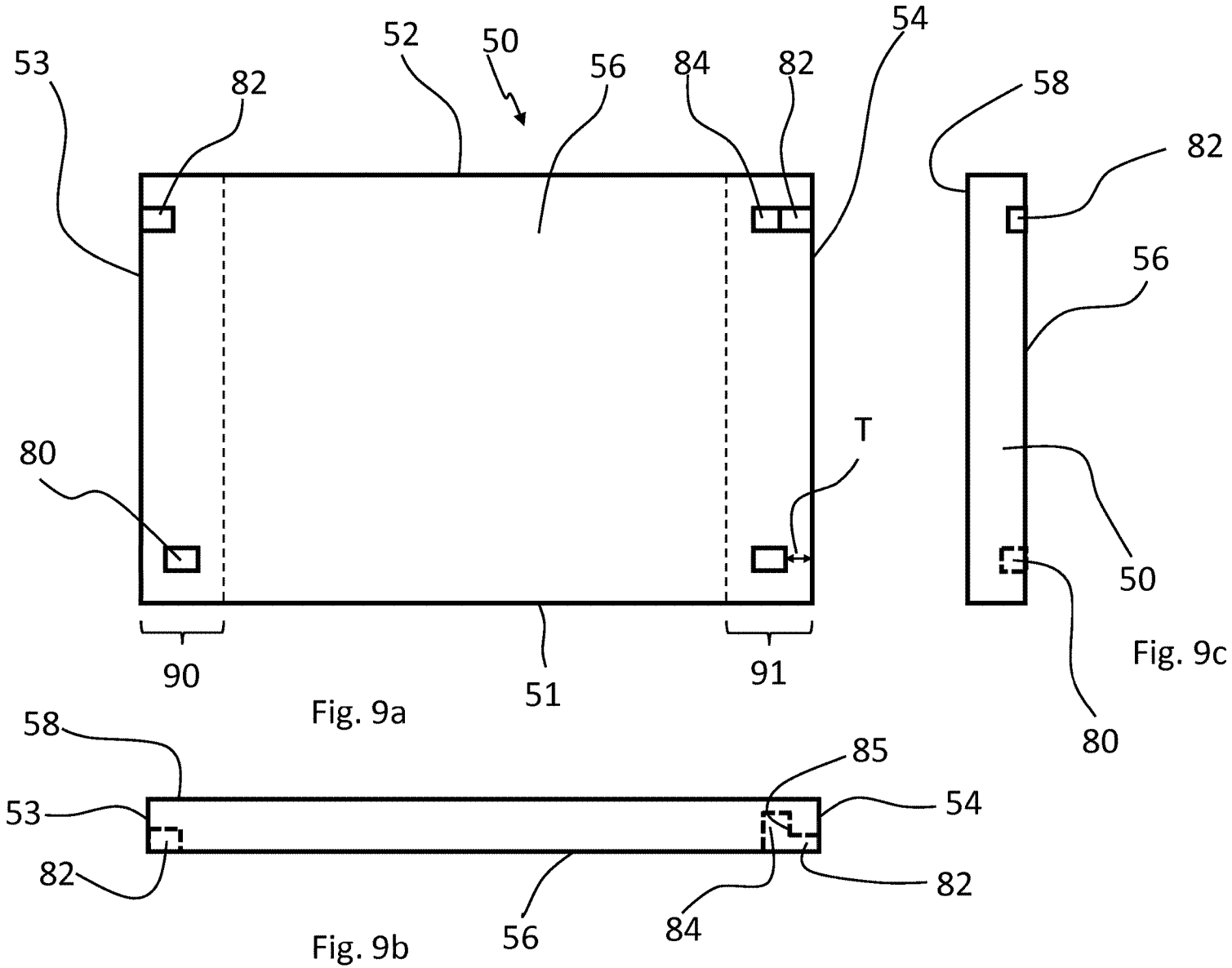
FIG. 9*a* shows a shelf plate as seen from below.
FIG. 9*b* shows the shelf plate shown in FIG. 9*a* as seen from side.
FIG. 9*c* shows the shelf plate shown in FIG. 9*a* as seen from another side.

FIG. 9*a* shows a shelf plate 50. The shelf plate 50 comprises a front end 51, back end 52 and first side edge 53, second side edge 54 and the shelf plate surfaces 56, 58 between the front end 51, and the back end 52 as well as between the first side edge 53 and the second side edge 54. FIG. 9*a* shows the bottom surface 56 of the shelf plate 50. The shelf plate 50 is supported on the support parts 30 of the shelf supports 10 between two opposing vertical side walls 70, as shown in FIG. 11. The shelf supports 10 are attached to the vertical side walls 70 and the shelf plate 50 is placed on the support parts 30 of the shelf supports 10 such that the support parts 30 support the shelf plate 50 from the bottom surface 56 or from the side of the bottom surface 56, and from side edge area 90, 91 of the bottom surface 56. The side edge areas 90, 91 extending parallel to the side edges 53, 54.

The support parts 30 may be placed directly against the bottom surface 56 of the shelf plate 50. Alternatively, the bottom surface 56 of the shelf plate 50 comprises a groove 82 extending from the side edge 53, 54, as shown in FIGS. 9*a*, 9*b* and 9*c*. The groove 82 may receive the support part 30 such that the support part 30 is at least partly inside the groove 82. Alternative, or additionally the bottom surface 56 may comprise a support hole 80, 84 having a counter surface 85. The support hole may be separate hole 80 or it may in connection with the groove 82. The counter surface 85 forms a recess into the shelf plate 50 and faces opposite side edge 53, 54 of the shelf plate.

The support hole 80, 84 is arranged to receive the protrusion 35 of the shelf support 10 of FIGS. 3, 4 and 5. The protrusion 36 is provided to the support part 30 at the first distance T from the stopping surface 32 and arranged into the support hole 80, 84 provided to the bottom surface 56 of the shelf plate 50 at the first distance T from the side edge 53, 54 of the shelf plate 50. Further, the protrusion 36 may be provided to the support part 30 at the first distance T from the stopping surface 32 and arranged into the support hole 80, 84 provided to the bottom surface 56 of the shelf plate 50. The protrusion 36 comprising the retaining surface 38 extending transversely to the direction B perpendicular to the side wall surface 76 and the support hole 80, 84 comprises the counter surface 85 provided between the side wall surface 76 and the retaining surface 38. The retaining surface 38 is placed against the counter surface 85, and behind the counter surface 85 when viewed from the side wall surface 76. The retaining surface 38 may be arranged at the first distance from the stopping surface 32 and counter surface 85 may be at the same first distance T from the side edge 53, 54 of the shelf plate 50.

Accordingly, the protrusion 36 forms a hook or retainer placed behind the counter surface 85 when viewed from the direction B perpendicular to the side wall surface 76 from the side wall surface 76 towards the shelf plate 5.

The invention has been described above with reference to the examples shown in the figures. However, the invention is in no way restricted to the above examples but may vary within the scope of the claims.

The invention claimed is:

1. A shelf support for supporting a shelf plate to a side wall of a shelf, the shelf support is arranged to be installed into a side wall aperture provided to a side wall surface of the side wall, the shelf support comprising:

- a support part arranged to be extending outside of the side wall aperture and to support the shelf plate;
- a pin part arranged to be inserted into the side wall aperture; and
- a stopping surface provided to the support part and defining a stopping plane, the pin part protruding from the stopping surface, the stopping surface being arranged to be placed against the side wall surface when the pin part is inserted into the side wall aperture, wherein the pin part extends from the stopping surface in a pin angle (X, Y) in relation to a direction (A) perpendicular to the stopping surface, the support part comprises an upper support surface arranged to be positioned towards the shelf plate, and the pin part extends from the stopping surface parallel to the upper support surface and in a first pin angle (X) in relation to the direction (A) perpendicular to the stopping surface when the shelf support is viewed from the support part towards the pin part, the upper support surface further defines an upper support plane perpendicular to the stopping plane, the upper support surface is arranged to extend from the stopping surface in a direction away from the pin part, the support part is further provided with a protrusion protruding upwards from the upper support surface, the protrusion is provided to the support part at a distance (T) from the stopping surface.

2. The shelf support according to claim 1, wherein the pin part extends from the stopping surface upwards or downwards in relation to the upper support surface and in a second pin angle (Y) in relation to the direction (A) perpendicular to the stopping surface when the shelf support is viewed from the support part towards the pin part.

3. The shelf support according to claim 1, wherein the support part comprises the upper support surface arranged to be positioned towards the shelf plate, the upper support surface defining the upper support plane, and that the pin part extends from the stopping surface in a direction parallel to the upper support plane and in the first pin angle (X) in relation to the direction (A) perpendicular to the stopping surface;

the support part comprises the upper support surface arranged to be positioned towards the shelf plate, the upper support surface defining the upper support plane, and that the pin part extends from the stopping surface upwards or downwards in relation to the upper support plane in the second pin angle (Y) in relation to the direction (A) perpendicular to the stopping surface; or the support part comprises the upper support surface arranged to be positioned towards the shelf plate, the upper support surface defining the upper support plane, and that the pin part extends from the stopping surface upwards or downwards in relation to the upper support plane in the second pin angle (Y) in relation to the direction (A) perpendicular to the stopping surface, and that that the pin part further extends from the stopping surface in a direction parallel to the upper support plane and in the first pin angle (X) in relation to the direction (A) perpendicular to the stopping surface.

4. The shelf support according to claim 1, wherein the support part comprises the upper support surface arranged to be positioned towards the shelf plate, the upper support surface defining the upper support plane perpendicular to the stopping plane, and the pin part extends from the stopping surface in a direction parallel to the upper support plane and in the first pin angle (X) in relation to a direction (A) perpendicular to the stopping plane;

the pin part extends from the stopping surface in the second pin angle (Y) in relation to the direction (A) parallel to a plane perpendicular to the stopping plane and the upper support plane; or the pin part extends from the stopping surface in the first pin angle (X) in relation to a direction (A) perpendicular to the stopping plane in a direction parallel to the upper support plane and in the second pin angle (Y) in relation to the direction (A) parallel to a plane perpendicular to the stopping plane and the upper support plane.

5. The shelf support according to claim 1, wherein the pin angle (X, Y), or the first pin angle (X) or the second pin angle (Y) is between:

5 to 60 degrees;

5 to 45 degrees;

5 to 25 degrees; or 7 to 20 degrees.

6. The shelf support according to claim 1, wherein the support part comprises the protrusion protruding upwards from the upper support surface arranged to be positioned towards the shelf plate, the protrusion is provided to the support part at a first distance (T) from the stopping surface;

the support part comprises the protrusion protruding upwards from the upper support surface arranged to be positioned towards the shelf plate, the protrusion is provided to the support part at the first distance (T) from the stopping surface and comprising a retaining surface extending in transverse direction in relation to the direction (A) perpendicular to the stopping surface and upwards from the upper support surface; or the support part comprises the protrusion protruding upwards from the upper support surface arranged to be positioned towards the shelf plate, the protrusion is provided to the support part at the first distance (T) distance from the stopping surface and comprising a retaining surface extending parallel to the stopping surface and upwards from the upper support surface.

7. The shelf support according to claim 1, wherein the pin part defines a central longitudinal axis that is parallel with the upper support plane of the upper support surface.

8. The shelf support according to claim 1, wherein the protrusion has a planar upper support surface that is parallel with the upper support plane of the upper support surface of the support part and perpendicular to the stopping plane of the stopping surface.

9. The shelf support according to claim 1, wherein the support part has a lateral side surface extending downwardly from a lateral edge of the upper support surface of the support part, wherein the first pin angle (X) of the pin part is such that a distal end of the pin part is disposed at least partially laterally outside of a plane defined by the lateral side surface of the support part.

10. The shelf support according to claim 1, wherein the upper support surface is planar.

11. The shelf support according to claim 10, wherein the support part has a bottom surface that is opposite to the upper support surface, the bottom surface being planar.

* * * * *